United States Patent [19]

Glomb et al.

[11] 4,207,143

[45] Jun. 10, 1980

[54] METHOD FOR ADDING MOISTURE TO A TRAVELING WEB

[75] Inventors: John W. Glomb, Silver Spring; Gerard P. Closset, Columbia, both of Md.

[73] Assignee: Westvaco Corporation, New York, N.Y.

[21] Appl. No.: 731,985

[22] Filed: Oct. 13, 1976

[51] Int. Cl.[2] ..... D21J 11/00

[52] U.S. Cl. ..... 162/207; 34/23

[58] Field of Search ..... 162/290, 207; 34/10, 34/23, 156; 118/68; 239/553.3

[56] References Cited

U.S. PATENT DOCUMENTS

| | | | |
|---|---|---|---|
| 3,560,333 | 2/1971 | Douglas et al. | 162/207 |
| 3,587,177 | 6/1971 | Overly | 34/156 |
| 3,782,330 | 11/1974 | Kanda | 118/68 |
| 3,938,261 | 2/1976 | Anderson | 162/207 |

FOREIGN PATENT DOCUMENTS

| | | | |
|---|---|---|---|
| 917065 | 1/1963 | United Kingdom | 162/207 |

*Primary Examiner*—William F. Smith

[57] ABSTRACT

Moisture is added to a traveling web of paper or the like by passing the web over one or more steamfoil nozzle devices which emit substantially dry steam vapor into the region between the web and the steamfoil. The steamfoil nozzle or nozzles extend across the web from side-to-side and the velocity of the emitted steam vapor is such that it produces a pressure differential between the side of the web adjacent the steamfoil and the opposite side of the web so that the web is urged toward the steamfoil where it rides on a cushion provided by the steam vapor and the boundary layer air surrounding the web. The steam vapor condenses on and in the relatively cool web when the web is passed over the steamfoil and the substantially dry steam vapor is mixed with the boundary layer air associated with the web. The steam flow disrupts the boundary layer air to permit intimate contact of the steam with the web to add moisture to the web.

4 Claims, 2 Drawing Figures

METHOD FOR ADDING MOISTURE TO A TRAVELING WEB

BACKGROUND OF THE INVENTION

In the manufacture of paper, it is customary to dry paper to a relatively low moisture content in order to achieve a uniform CD (cross direction) moisture profile. This is true despite the fact that it is known that paper having a relatively high moisture content will fold better, finish easier and give less trouble from curling than paper of lower moisture content. Moreover, printing paper having a high initial moisture content, when conditioned at normal press room humidity, comes to equilibrium by loss of moisture (with a desirably higher moisture content) than paper of lower moisture content which comes to equilibrium by absorption of moisture. However, in order to overcome moisture profile problems originating at the wet end, press section and drier sections of a papermachine, it is common practice to dry the rawstock to a relatively low moisture content. Thus, as regards the paper industry, the controlled and uniform application of moisture to rawstock and/or coated webs is a goal of great interest, and by the present invention, such a goal has been achieved.

Several methods have been proposed in the prior art for applying moisture to a moving sheet or web. Examples of these include roll applicators such as the Dahlgren-type systems, electrostatic spray systems, steam shower devices and water doctor systems particularly as disclosed in the following prior U.S. Pat. Nos.: 3,379,170, 3,776,471, 3,873,025, 3,467,541, 3,735,929, 3,922,129, 3,625,743, 3,782,330.

In general, however, the methods disclosed in the above noted patents involve the use of expensive, complicated and unreliable equipment without any means for achieving a uniform CD moisture profile and/or for the controlled application of small quantities of moisture.

Other examples for adding moisture to a web include, a method and apparatus for applying steam to and condensing moisture on a web that is backed by a heat conducting body as disclosed in U.S. Pat. No. 2,370,811, and a device similar to that disclosed herein that directs a humid atmosphere toward the web, as disclosed in U.S. Pat. No. 3,238,635. However, a careful review of the latter mentioned patents will show that in one case, condensation of steam vapor on the web is produced because the web is backed by a heat sink or metal roll through which a cooling fluid is passed. Meanwhile, in the other patent, where the humid atmosphere directed toward the web is derived from steam, the final mixture applied to the web is so complete that the steam loses all identity as such in the humid atmosphere, and, the emitted premixture is not impelled or jetted adjacent to the web.

In contrast to the methods and apparatus disclosed in the above noted prior art, applicants' invention utilizes a method whereby steam in a substantially dry state is emitted under pressure and at a velocity greater than that of a traveling web into the region between a web and a steamfoil nozzle device. The emitted steam produces a low pressure region between the traveling web and the steamfoil and disrupts the boundary layer air associated with the traveling web to permit intimate contact of the steam with the web. When the steam mixes with the boundary layer air associated with the traveling web, condensation in and on the web occurs to add moisture to the web.

In this respect, applicants' invention relies on principles previously disclosed in connection with the use of airfoil type web drying systems for use in drying paper webs. The latter principles are fully disclosed in the following prior U.S. Pat. Nos. and publications:

3,587,177, 3,711,960, 3,650,043, 3,629,952

TAPPI, April 1973, Vol. 56, No. 4, pp. 86–89

TAPPI, June 1974, Vol. 57, No. 6, pp. 105–107

TAPPI, April 1976, Vol. 59, No. 4, pp. 92–96

Accordingly, it may be seen from the above noted disclosures that although the general operating principles behind applicants' invention have been previously proven, applicants are the first to utilize those principles with the application of steam to a web to add moisture to the web.

SUMMARY OF INVENTION

In general, the present invention is directed to a method and apparatus for adding moisture to a traveling web of paper or the like. More specifically, the present invention utilizes substantially dry steam to add moisture to a traveling web when the web is passed over a steamfoil nozzle device and steam is emitted under pressure and at a high temperature and velocity from the slot portion of the steamfoil into the region between the web and steamfoil wherein the steam mixes with the boundary layer air associated with the traveling web and condensation in and on the web occurs. The emitted steam at high velocity disrupts the boundary layer surrounding the traveling web to produce an intimate contact of the steam with the relatively cooler web. With the web in close proximity to the steamfoil, the reduction in pressure produced by the high velocity steam flow draws the web toward the steamfoil. However, the web becomes stabilized near the steamfoil when a dynamic balance is established to position the traveling web near but not touching the steamfoil. The gap or space between the traveling web and the steamfoil depends primarily upon the draw length, web tension, and steam flow rate. When the steam mixes with the boundary layer air associated with the traveling web, condensation in and on the web occurs to add moisture to the web. Thus it may be seen that the steamfoil device of the present invention with its high velocity steam flow effectively provides several desirable results including, (1) a disruption of the boundary layer air associated with the traveling web to produce an intimate contact between the steam flow and the web, (2) an enhanced and uniform moisture pick-up by the web, and (3) a dynamically balanced condition in the region of the steamfoil which stabilizes the web thus obviating the undesirable web fluttering and non-uniform moisture addition that occurs when steam nozzles are placed normal to a web. For a typical production installation, the steam velocity rate at the slot of the steamfoil should be greater than the web velocity and the pressure in the steamfoil should be above atmospheric pressure. Experience has shown that a steam pressure of at least about 0.1 inch of water is required for practical operation. Since the steam is introduced at a pressure above atmospheric pressure, and the steam flow velocity is maintained at a level greater than web speed, the present method produces substantially the same results notwithstanding the direction of web travel, i.e., counter to, or in the same direction as the emitted steam flow direction.

DETAILED DESCRIPTION

Figure 1:
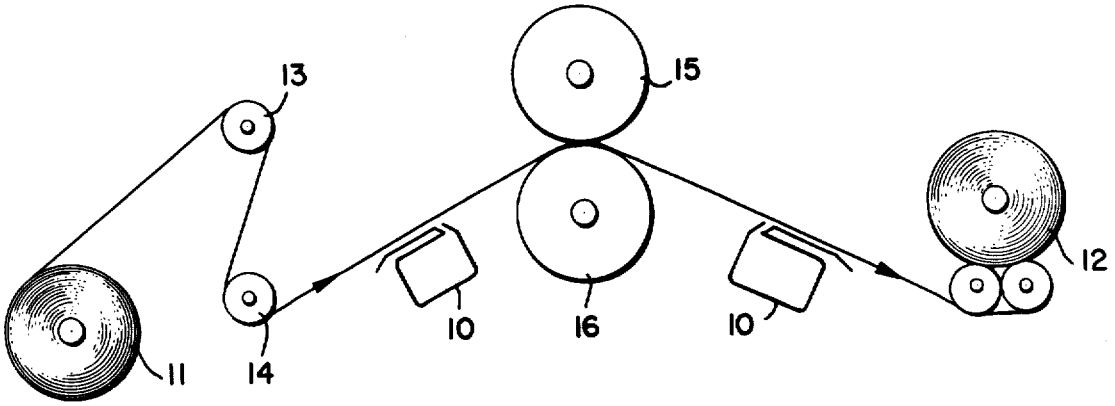
FIG. 1 of drawing illustrates schematically a typical installation of an airfoil nozzle device for use in adding moisture to a web of paper or the like; and, FIG. 2 shows an enlarged sectional view of a typical airfoil nozzle device.

Referring to the drawing, it may be seen that the steamfoil nozzle devices 10 are typically located between an unwind stand 11 and a rewind stand 12 so as to direct the steam flow either counter to or in the same direction as the web travel. The web may pass over one or more turning rolls 13,14 prior to the steamfoil for conditioning a web before calendering, or the steamfoil may be located after a typical calender stack designated by the rolls 15,16. It should be understood, however, that many other locations on or off the papermachine may be chosen for the steamfoil device or devices depending upon the end results required and the type of web being conditioned. Moreover, where two or more steamfoil nozzle devices are employed, the units may be located together on one side of the web, or on each side of the web substantially as utilized in the airfoil type web drying systems disclosed in the prior art.

Figure 2:
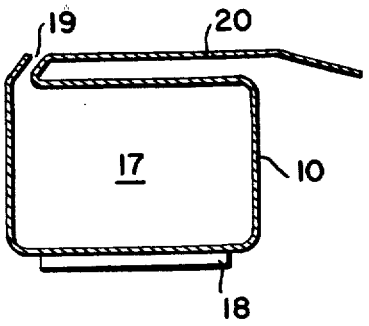

FIG. 2 shows in some detail a typical steamfoil nozzle device suitable for the present invention. Basically, the steamfoil device 10 consists of an integral plenum chamber 17 that extends across the web from side-to-side with a steam inlet 18. It is understood that the connections to the plenum chamber also include suitable condensate separators, drains, pressure and temperature measuring devices and steam flow control valves (not shown). The steamfoil nozzle device 10 also includes at the top portion thereof an integral steam emitting slot 19 and a foil member 20. The slot portion 19 and foil portion 20 provide a restricted opening for discharge of steam vapor under pressure into the region defined by the foil member 20 and the web. It should be understood, however, that the foil member 20 may be a separate member or provided as an extension of the plenum chamber 17 as desired. The only requirement for the system is that the slot 19 and foil 20 should be located in close proximity to one another to provide the results mentioned hereinbefore. As will be noted from the aforementioned prior art, the top of the plenum 17 could readily serve as the foil member.

The effectiveness of the preferred embodiment of the present invention will be demonstrated by considering the following Examples.

EXAMPLE I

Two paper samples in web form (a 38 lb/ream Marva Web Gloss rawstock and an 80 lb/ream Sterling Litho Gloss machine finished coated paper, both products of Westvaco Corporation ream size 500 sheets measuring 25×38 inches) were treated with steam from a modified airfoil nozzle device manufactured by TEC Systems, Inc. De Pere, Wisconsin. The modifications to the airfoil device consisted of those required to convert it for use with steam. The direction of web travel was the same as the direction of the emitted steam flow and the web traveled approximately 13 inches before being rewound in order to minimize evaporation of the applied moisture. The gap between the web and steamfoil was maintained at approximately ⅛ inch with the results shown in Table I.

TABLE I

Effect of Web Temperature and Speed on Moisture Pickup Gap - ⅛ inch Between Web and Steamfoil

| Web Temp. (° F.) | Steam Press (inches $H_2O$) | Web Speed (fpm) | Web Moisture (%) | Moisture Pickup (%) |
|---|---|---|---|---|
| | (38 lb. Marva Web Rawstock) | | | |
| 80 | Control | — | 3.6 | — |
| 80 | 1.0 | 1000 | 5.8 | 2.2 |
| 80 | 1.0 | 1500 | 5.35 | 1.75 |
| 80 | 3.0 | 500 | 6.5 | 2.9 |
| 80 | 3.0 | 1000 | 6.2 | 2.6 |
| 80 | 3.0 | 1500 | 5.7 | 2.1 |
| 160 | Control | — | 2.0 | — |
| 160 | 3.0 | 1000 | 3.75 | 1.75 |
| 160 | 3.0 | 1500 | 3.20 | 1.2 |
| 160 | 3.0 | 500 | 3.95 | 1.95 |
| 160 | 1.0 | 1000 | 3.40 | 1.40 |
| 160 | 1.0 | 1500 | 3.15 | 1.15 |
| | (80 lb. Sterling Litho) | | | |
| 80 | Control | — | 3.60 | — |
| 80 | 2.25 | 500 | 5.25 | 1.65 |
| 80 | 2.25 | 1000 | 4.40 | 0.80 |
| 80 | 2.25 | 1500 | 4.0 | 0.40 |
| 170 | Control | — | 1.20 | — |
| 170 | 2.25 | 500 | 1.88 | 0.68 |
| 170 | 2.25 | 1000 | 1.50 | 0.30 |
| 170 | 2.25 | 1500 | 1.40 | 0.20 |

Based on the results obtained in Example I, several variables were found to affect moisture pickup including steam pressure in the steamfoil device, web temperature and web speed. For a web temperature of 80° F. (measured prior to steamfoil device), a web speed of 1500 fpm and a steam pressure of 3 inches of $H_2O$, the moisture content of the web was increased from an initial level of 3.6% to 5.7% with the Marva Web Gloss rawstock, representing a gain of approximately 0.79 lb/ream. When the web temperature was increased to 160° F., all other conditions remaining the same, moisture pickup was reduced to about 1.2%. A reduction in steam pressure from 3 inches to 1 inch of $H_2O$ (steam flow rate reduced from about 165 ft/sec. to about 95 ft/sec) produced a reduction in moisture pickup of approximately 20%. Similarly, the moisture pickup dropped as the web speed was increased. However, a reduction in moisture pickup with the hotter web would be consistent with both the smaller energy sink provided by the web and the reduced driving force for steam condensation.

Since two possible mechanisms are deemed possible for moisture transfer to the web with the present invention, namely, (1) condensation of steam in and on the web caused by contact of the steam with the cooler web, and (2) impingement on the web of water droplets, i.e., the partial condensation of the steam into water droplets as a result of the mixing of the steam with the boundary layer air in the region between the web and steamfoil, the temperature of the incoming web plays a major role in determining the moisture pickup. For instance, the maximum possible moisture transfer by condensation (assuming an excess supply of steam) is limited by the initial temperature of the web. Also, since the web is heated by the steam condensing on its surface, as the web temperature increases, the driving forces for condensation decrease. Obviously, no further net condensation on or in the web would be expected to occur once the web reached 212° F.

EXAMPLE II

A second sample of the 50 lb/ream Marva Web Gloss rawstock was treated with the steamfoil nozzle device as described in Example I to study the effect of varying the gap between the web and airfoil. The results obtained are shown in Table II.

TABLE II

Effect of Gap on Moisture Pickup
Web Speed: 1000 fpm
Web Temperature: 80° F.

| Gap Dimension (inches) | Steam Pressure (inches $H_2O$) | Moisture Pickup (%) |
|---|---|---|
| 1/8 | 1.0 | 2.48 |
| 1/8 | 1.0 | 2.20 |
| 1/4 | 1.0 | 1.62 |
| 1/4 | 1.0 | 1.80 |
| 1/2 | 1.0 | 1.0 |
| 1/2 | 1.0 | 1.10 |
| 1 | 1.0 | 0.63 |
| 1 | 1.0 | 0.60 |
| 2 | 1.0 | 0.34 |
| 2 | 1.0 | 0.35 |
| 1/8 | 3.0 | 3.00 |
| 1/4 | 3.0 | 2.50 |
| 1/2 | 3.0 | 2.00 |

As can be seen from the results in Table II, the level of moisture picked up by the web decreased as the foil-to-web gap was increased. Other observations noted were that the amount of steam condensed in the region between the web and steamfoil was affected by the quantity of ambient air or boundary layer air carried into the gap by the traveling web, and that the process produced an overall efficiency of from about 5-15%.

EXAMPLE III

A 60 lb./ream machine finished coated paper (Velco Web Gloss paper, a product of Westvaco Corporation) was treated with the steamfoil substantially as disclosed in the prior two Examples. The steamfoil was arranged to emit the steam flow in a direction opposite to the direction of web travel and the gap between the web and steamfoil was allowed to be determined naturally by the steam flow which attracted the web toward the foil. The observed gap was about 1/8 inch. After passing over the steamfoil, the web traveled approximately 16 feet to a rewind stand at a web speed of 2000 fpm taking about 1/2 second. Steam pressure in the steamfoil was varied from 0.5 to 5 inches of water and produced moisture pickups as shown in Table III.

TABLE III

Moisture Pickup vs. Steam Pressure
Web Speed: 2000 fpm

| Web Temp. (° F.) | Steam Pressure (inches $H_2O$) | Web Moisture (%) | Moisture Pickup (%) |
|---|---|---|---|
| 130 | Control | 3.48 | — |
| 130 | 0.5 | 4.00 | 0.52 |
| 130 | 1.0 | 4.33 | 0.85 |
| 130 | 2.0 | 4.35 | 0.87 |
| 130 | 5.0 | 4.62 | 1.14 |
| 130 | Control | 3.56 | — |
| 130 | 3.0 | 4.40 | 0.84 |
| 130 | 4.0 | 4.46 | 0.90 |

From the results shown in Table III, it can be seen that the moisture pickups tended to increase with increasing steam pressure at constant web speed. The moisture application was uniform and free of droplets. The effect of the mixing of the boundary layer air with the steam flow was quite visible with the steam/air mixture ranging from several feet ahead of the steamfoil to about 1 to 2 feet behind the steamfoil.

EXAMPLE IV

A 50 lb/ream machine finished coated paper (Field Web Offset paper manufactured by Westvaco Corporation) was treated with the steamfoil device described hereinbefore prior to passing the paper through a supercalender. The objective of the experiment was to determine the limits of moisture application suitable for improving the finishing characteristics of the paper without producing picking. Web temperature was maintained at about 80° F. and the gap between the web and foil at about 1/2 inch. The steamfoil was located approximately 10 inches prior to entering the nip of a single nip cotton/steel supercalender apparatus operating at 400 pli. Steam flow was directed opposite to the direction of web travel, and the results are set forth in Table IV.

TABLE IV

| Steam Press (inches $H_2O$ | Calender Speed (fpm) | Web Moisture (%) | Moisture Pickup (%) | Visual Observations |
|---|---|---|---|---|
| Control | — | 3.20 | — | no picking |
| 0.1 | 400 | 4.00 | 0.80 | no picking |
| 0.1 | 1500 | 3.85 | 0.65 | no picking |
| 0.5 | 400 | 5.18 | 1.98 | picking |
| 1.0 | 400 | 5.40 | 2.20 | picking |
| 2.0 | 400 | 5.85 | 2.65 | picking |

From the results set forth in Table IV it may be seen that only the smallest moisture pickups produced a condition where there was no picking on the steel roll. Thus, as the moisture pickup by the web increased, the coated web began to leave deposits of coating on the surface of the steel roll. However, the experiment demonstrated that low levels of moisture could be applied uniformly to a web and produce improvements in the finishing characteristics of the paper.

Thus is may be seen that the method and apparatus of the present invention provides a satisfactory process for adding moisture to coated and uncoated webs of paper which is uniform and controllable. It will be understood, however, that the present invention could provide equally good results for webs of other material which require an increased moisture content. Moreover, it will be understood that the present invention is subject to modifications and changes to the preferred embodiment fully disclosed which do not depart from the spirit and scope of the appended claims.

We claim:

1. A method for the controlled application of small quantities of moisture in the range of from about 0.20 to 3.0% to a traveling web of paper or the like comprising:

(a) providing a steamfoil nozzle device connected to a source of substantially dry steam vapor at a pressure greater than atmospheric pressure adjacent to the path of a traveling web of paper or the like;

(b) passing said traveling web in close proximity to said steamfoil nozzle device;

(c) adjusting the gap between said traveling web and said steamfoil nozzle device in order to control the amount of moisture picked up by the traveling web;

(d) emitting from said nozzle into the gap between said web and steamfoil device a quantity of said substantially dry steam vapor at a nozzle velocity greater than the web velocity so that the web is drawn toward said steamfoil device to ride on a cushion provided by the steam vapor and the air surrounding said web without touching said steamfoil device;

(e) disrupting the boundary layer air associated with said web to produce an intimate contact between the steam flow and the web; and, (f) mixing the boundary layer air associated with the traveling web with the steam to produce condensation in and on the web and provide a uniform addition of moisture to said web.

2. The method of claim 1 wherein the dry steam vapor in the steamfoil nozzle device is at a pressure of from about 0.10 to 5 inches of $H_2O$.

3. The method of claim 2 wherein the dry steam vapor is emitted from the nozzle in the same direction as the direction of travel of the web.

4. The method of claim 2 wherein the dry steam vapor is emitted from the nozzle in a direction opposite to the direction of travel of the web.

* * * * *